US005245325A

United States Patent [19]

Terada

[11] Patent Number: 5,245,325

[45] Date of Patent: Sep. 14, 1993

[54] METHOD FOR DRIVING AN STN LIQUID CRYSTAL DISPLAY DEVICE

[75] Inventor: Toshiyki Terada, Tokyo, Japan

[73] Assignee: Stanley Electric Co., Ltd., Tokyo, Japan

[21] Appl. No.: 772,843

[22] Filed: Oct. 8, 1991

[30] Foreign Application Priority Data

Oct. 22, 1990 [JP] Japan ..... 2-283975

[51] Int. Cl.[5] ..... G09G 3/36

[52] U.S. Cl. ..... 345/101; 359/86; 345/204

[58] Field of Search ..... 340/784, 716, 815.06, 340/723, 724, 736, 791; 359/86; 358/220

[56] References Cited

U.S. PATENT DOCUMENTS 4,130,830 12/1978 Derickson ..... 358/220
4,338,623 7/1982 Asmus et al. ..... 358/220
4,555,701 11/1985 Dahl et al. ..... 340/736
4,581,612 4/1986 Jones ..... 340/791
4,653,094 3/1987 Rasmussen et al. ..... 340/716
4,838,661 6/1989 McKee et al. ..... 359/86
4,922,237 5/1990 Inoue ..... 340/791

*Primary Examiner*—Ulysses Weldon
*Assistant Examiner*—Regina Liang
*Attorney, Agent, or Firm*—Frishauf, Holtz, Goodman & Woodward

[57] ABSTRACT

A method for driving an STN liquid crystal display device, which can prevent a printed phenomenon of display on an image plane. In this method, when a display time of a fixed pattern exceeds a set time, ON and OFF of the fixed pattern is forcibly reversed to momentarily provide an inverted pattern, after which the display is returned to the original fixed pattern.

5 Claims, 1 Drawing Sheet

FIG. 1(A)
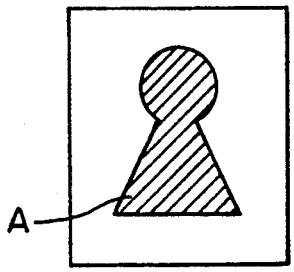
FIG. 1(B)
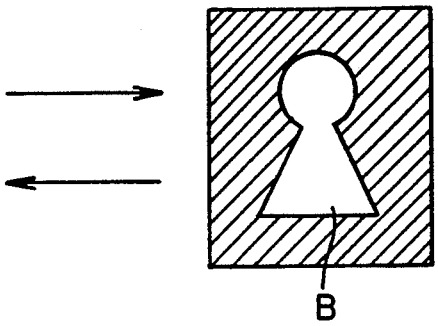
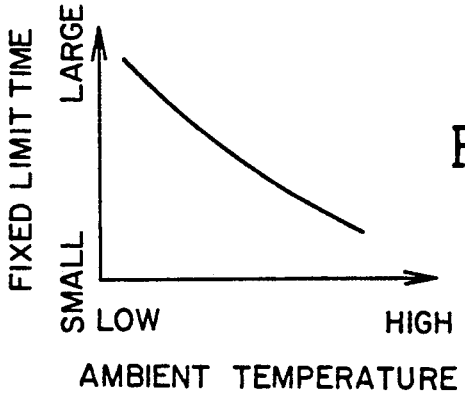
FIG. 2
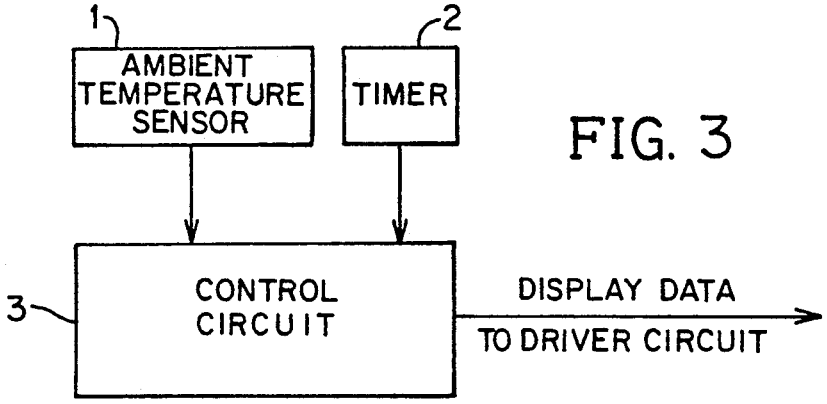
FIG. 3

METHOD FOR DRIVING AN STN LIQUID CRYSTAL DISPLAY DEVICE

BACKGROUND OF THE INVENTION

1. Field of the Invention

The present invention relates to a method for driving an STN liquid crystal display device, and particularly to a driving method for preventing a printed phenomenon of a display on an image plane.

2. Description of the Prior Art

When a fixed image pattern such as a figure, a character, a picture, etc. is continuously displayed on a STN (Super Twisted Nematic) liquid crystal display device for a long period of time, a so-called printed phenomenon occurs in which even if a display is changed, a pattern having been displayed for a long period of time remains visible without completely disappearing. This phenomenon conspicuously appears particularly at a high temperature.

For this reason, when the device is used under severe conditions such as in motor vehicles, the display printed phenomenon comes into question. It has been desired to develop countermeasures to this phenomenon.

SUMMARY OF THE INVENTION

It is therefore an object of the present invention to provide a method for driving an STN liquid crystal display device which can prevent a display printed phenomenon.

According to one feature of the present invention, when a display time of a fixed pattern exceeds a set time, ON and OFF of the fixed pattern is forcibly reversed to momentarily provide an inverted pattern, after which the display is returned to the original fixed pattern. A printed phenomenon of a display is prevented, and the quality of the display and the contrast are enhanced.

BRIEF DESCRIPTION OF THE DRAWINGS

FIGS. 1(A) and 1(B) show a fixed display pattern and its inverted pattern, respectively, for explaining one embodiment of a method for driving an STN liquid crystal display device according to the present invention;

FIG. 2 is a characteristic view showing a relationship (for a control table) between an ambient temperature and a fixed limit time; and FIG. 3 is a control block diagram.

DESCRIPTION OF THE PREFERRED EMBODIMENT

In the case where a display pattern A as shown in FIG. 1(A) is fixedly displayed on an STN liquid crystal display device for a predetermined period of time or more, when the time exceeds a set time (within the display time), the pattern A is momentarily reversed to an image pattern (an inverted pattern) B as shown in FIG. 1(B). That is, in the fixed display image pattern of FIG. 1(A), the dots of ON and the dots of OFF are turned OFF and ON, respectively. After a given period of time, for example one second, the display is returned to the original fixed display image pattern of FIG. 1(A).

In this case, a relationship between an ambient temperature of the STN liquid crystal display device used and a fixed limit time at which printing does not occur (FIG. 2) is obtained in advance, and control is made on the basis of the aforesaid relationship.

In FIG. 2, the horizontal axis shows an ambient temperature and the vertical axis shows a fixed limit time at which burn in (or printing) occurs. Namely, by use of FIG. 2, one can read a time and an ambient temperature at which burn in does not occur. The limit time becomes shorter as the ambient temperature becomes higher. Accordingly, FIG. 2 shows that the set time should be less than the limit time, i.e., less than the value of the curve of the graph line.

FIG. 3 is a control block diagram, in which reference numeral 1 designates an ambient temperature sensor; 2 a timer; and 3 a control circuit. Data of temperature and set time are set in the control circuit 3 so that when a limit time at a certain temperature is reached, the display data is immediately inverted. The display of the inverted pattern B (FIG. 1(B)) is set to approximately one second, and the inverted pattern B is immediately returned to the original fixed display image pattern A (FIG. 1(A)).

In the case where a fixed image pattern is displayed for a long period of time, when an inverted pattern is momentarily displayed every set time, the printed phenomenon of display is prevented when the inverted pattern is changed into the other or original display pattern. Thereby, the quality of display and the contrast are improved, and an erroneous display is prevented.

As described above, according to the present invention, in the case where one and the same pattern continues to be displayed on the STN liquid crystal device for a long period of time, a display of an inverted pattern is introduced every set time. Therefore, the improvement in the quality of the display and the contrast can be expected, and the erroneous display can be effectively prevented.

What is claimed is:

1. In a method for driving a super twisted nematic liquid crystal display device, wherein a fixed pattern is displayed thereon, the improvement comprising:

sensing ambient temperature with a temperature sensor;

reversing a fixed pattern being displayed on said display device so as to display on said display device an inverted pattern which is the inverse of said fixed pattern, responsive to a display time of the fixed pattern exceeding a set time;

controlling said set time with a control circuit as a function of an output of said temperature sensor, said set time being varied such that said set time becomes shorter as the sensed ambient temperature becomes higher and said set time becomes longer as said sensed ambient temperature becomes lower; and reversing said inverted display pattern to the original fixed pattern after a given period of time to thereby again display the original fixed pattern on said display device, said given period of time being set with a timer.

2. The method of claim 1, wherein said given period of time for display of said inverted display pattern is about one second.

3. An apparatus for driving a super twisted nematic liquid crystal display device, comprising:

means for causing said liquid crystal display device to display a fixed pattern;

means for detecting that said fixed pattern is displayed for a time period which exceeds a set time;

a temperature sensor for sensing ambient temperature;

control means responsive to said temperature sensor for controlling said set time as a function of the sensed ambient temperature such that said set time is shorter when said sensed ambient temperature is high and is longer when said sensed ambient temperature is low;

means for reversing said fixed pattern, after said display time exceeds said set time, to display on said display device an inverted pattern which is the inverse of said fixed pattern;

a timer for setting a given period of time;

means for reversing said inverted display pattern to the original fixed pattern after said given period of time, to thereby again display the original fixed pattern on said display device.

4. The apparatus of claim 3, wherein:

said means for reversing said fixed pattern repetitively reverses said fixed pattern to said inverted pattern each time the display of said fixed pattern exceeds a set time; and said means for reversing said inverted display pattern reverses said inverted display pattern back to the original fixed pattern after said given period of time.

5. The apparatus of claim 3, wherein said inverted display pattern is displayed for about one second.

* * * * *